US012022896B2

(12) United States Patent
Chan

(10) Patent No.: US 12,022,896 B2
(45) Date of Patent: Jul. 2, 2024

(54) SELF-CONTAINED FINGER SLEEVE

(71) Applicant: Wantsbase Limited, Kowloon (HK)

(72) Inventor: Chi Ho Chan, Yuen Long (HK)

( * ) Notice: Subject to any disclaimer, the term of this patent is extended or adjusted under 35 U.S.C. 154(b) by 45 days.

(21) Appl. No.: 18/014,517

(22) PCT Filed: May 24, 2021

(86) PCT No.: PCT/IB2021/054473
§ 371 (c)(1),
(2) Date: Jan. 5, 2023

(87) PCT Pub. No.: WO2022/008991
PCT Pub. Date: Jan. 13, 2022

(65) Prior Publication Data

US 2023/0255280 A1 Aug. 17, 2023

(30) Foreign Application Priority Data

Jul. 10, 2020 (CN) ..... 202010660510.7

(51) Int. Cl.
*A41D 13/08* (2006.01)
*A41D 31/18* (2019.01)

(52) U.S. Cl.
CPC ..... *A41D 13/087* (2013.01); *A41D 31/18* (2019.02)

(58) Field of Classification Search
CPC .. A41D 13/087; A41D 13/0081; A41D 31/18; A41D 19/0041; A41D 19/002; A41D 19/0034; A41D 19/0075; A41D 19/01594; A41D 2400/422; A41D 2400/42; A45C 13/1076; A45C 13/04; A45C 13/03; A45C 13/1053; A45C 13/083; A45C 11/00; B43M 99/008
See application file for complete search history.

(56) References Cited

U.S. PATENT DOCUMENTS 1,990,553 A * 2/1935 Hirsch ..... A41D 13/087 294/25
2,069,449 A * 2/1937 Jensen ..... A61F 13/105 D29/118
2,603,790 A * 7/1952 Boehm-Myro ..... A41D 19/01 2/160
4,933,992 A * 6/1990 Kallman ..... A41D 19/00 2/160

(Continued)

*Primary Examiner* — Alissa L Hoey
*Assistant Examiner* — Akwokwo Olabisi Redhead

(57) ABSTRACT

A self-contained finger sleeve, having a cover, a thumb pocket, and a four-finger pocket, each having an opening; one edge of the opening of the four-finger pocket is connected to an edge of the opening of the cover; an opposite edge of the opening of the four-finger pocket is connected to an edge of the opening of the thumb pocket via a U-shaped connecting strap; in a self-contained condition, the openings of the cover and the four-finger pocket face towards each other to define a storing space that stores the thumb pocket and the U-shaped connecting strap; in an unfolded condition, the four-finger pocket is flipped inside out and misaligned with the cover; the thumb pocket is exposed from the storing space and positioned on one side of the four-finger pocket flipped inside out; the thumb pocket and the four-finger pocket flipped inside out from and ergonomic finger sleeve.

10 Claims, 5 Drawing Sheets

(56) References Cited

U.S. PATENT DOCUMENTS

| | | | | |
|---|---|---|---|---|
| 4,959,881 | A * | 10/1990 | Murray | A47L 13/18 294/1.3 |
| 5,774,894 | A * | 7/1998 | Yates | A41D 19/0041 2/160 |
| 6,996,847 | B2 * | 2/2006 | Anderson | A41D 19/0013 2/16 |
| 7,862,094 | B1 * | 1/2011 | Lamont | A47L 13/52 294/1.3 |
| 8,833,816 | B2 * | 9/2014 | Hoffman | E01H 1/006 294/1.3 |
| 2010/0095425 | A1 * | 4/2010 | Dell | A47G 21/001 2/158 |
| 2018/0168248 | A1 * | 6/2018 | Cicco | A41D 13/087 |

* cited by examiner

SELF-CONTAINED FINGER SLEEVE

BACKGROUND OF THE INVENTION

The present invention relates to the field of safety and protection apparatus, and more specifically relates to a self-contained finger sleeve that provides safety and protection.

During pandemics, contact transmission by hands is one of the major ways to transmit virus and bacteria apart from droplet transmission. Therefore, besides protective masks that are worn to prevent droplet transmission, protective gloves are worn or intermediate barrier objects like tissues or toothpicks are used for the purpose of indirect contact so as to avoid contact transmission by hands.

Although pandemics can be effectively controlled by the above protective measures, said measures to avoid contact transmission by hands have the following deficiencies:

1. Protective gloves: Due to their leak tightness, moisture develops inside the gloves after a considerable period of use. Therefore, they can be used only once and then disposed and wasted. Also, used gloves may be infested by bacteria or virus on their surfaces, and thereby not favourable for storage and carrying.
2. Intermediate barrier objects like tissues or toothpicks: these objects are not equipped with any self-disinfection mechanism, and so they entail the risk of secondary pollution after being disposed, and this is significantly detrimental to the effective control of the pandemics, and not favourable to the protection of health and life of the citizens.

BRIEF SUMMARY OF THE INVENTION

In view of the aforesaid disadvantages now present in the prior art, the present invention provides a self-contained finger sleeve that provides safety and protection. The self-contained finger sleeve is easy to use and store, durable, and can be reused.

To achieve the above objects, the present invention provides the following technical solutions:

A self-contained finger sleeve, made of an elastic material, comprises a cover, a thumb pocket, and a four-finger pocket;

wherein the cover has an opening, the four-finger pocket has a pocket opening, and the thumb pocket also has a pocket opening; an edge of the pocket opening of the four-finger pocket is connected to an edge of the opening of the cover; and an opposite edge of the pocket opening of the four-finger pocket is connected to an edge of the pocket opening of the thumb pocket via a U-shaped connecting strap;

the opening of the cover has a shape that corresponds to a shape of the pocket opening of the four-finger pocket;

in a self-contained condition of the self-contained finger sleeve, the opening of the cover and the pocket opening of the four-finger pocket face towards each other such that interior of the cover and interior of the four-finger pocket are in communication with each other to define a storing space, and the thumb pocket and the U-shaped connecting strap are positioned in the storing space and enclosed by the cover and the four-finger pocket;

in an unfolded condition of the self-contained finger sleeve, the four-finger pocket is flipped inside out, and the pocket opening of the four-finger pocket after being flipped inside out is misaligned with the opening of the cover and positioned at a rear surface of the cover; also, the thumb pocket is exposed from the storing space and positioned on one side of the four-finger pocket flipped inside out; with the four-finger pocket and the thumb pocket connected via the U-shaped connecting strap, the thumb pocket and the four-finger pocket flipped inside out form an ergonomic finger sleeve where a thumb of a user is configured to be placed in the thumb pocket, and an index finger, a middle finger, a ring finger and a little finger of the user are configured to be placed in the four-finger pocket flipped inside out.

Further, the cover, the four-finger pocket, the U-shaped connecting strap, and the thumb pocket are integrally connected in sequence.

Further, an outer contour of the cover and an outer contour of the four-finger pocket are supported by shaping frames positioned at framing edges of a front surface of the cover, framing edges of the rear surface of the cover, framing edges of a front surface of the four-finger pocket, and framing edges of a rear surface of the four-finger pocket respectively; when the self-contained finger sleeve is in the self-contained condition where the front surface of the cover aligns with the front surface of the four-finger pocket, and the rear surface of the cover aligns with the rear surface of the four-finger pocket, the shaping frames of the cover align with the shaping frames of the four-finger pocket so that the self-contained finger sleeve in said self-contained condition has a shape of a rectangle when viewing from both a front surface and a rear surface of the self-contained finger sleeve.

Further, the self-contained finger sleeve in said self-contained condition has the shape of a rounded-corner rectangle when viewing from both the front surface and the rear surface of the self-contained finger sleeve, where four corners of the rounded-corner rectangle are rounded corners.

Further, two ends of a connecting portion between the cover and the four-finger pocket are formed as arcs respectively.

Further, a fixing structure is provided between the cover and the four-finger pocket to fix the cover and the four-finger pocket together when the self-contained finger sleeve is in the self-contained condition.

Further, the fixing structure is a fastening structure.

Further, the four-finger pocket is a single pocket in which the index finger, the middle finger, the ring finger and the little finger of the user are configured to be inserted.

Further, when the self-contained finger sleeve is in said unfolded condition where the thumb pocket and the four-finger pocket flipped inside out form the ergonomic finger sleeve, an inner side surface of the four-finger pocket flipped inside out corresponding to where four fingers get hold of the four-finger pocket is integrally provided with an anti-slippery protrusion.

Further, the elastic material is silicone or rubber.

The present invention has the following inventive concepts and advantages described below, as compared with prior arts:

1. The self-contained finger sleeve is made of elastic materials like silicone or rubber, thereby facilitating reuse of the self-contained finger sleeve while achieving changes of its different conditions.
2. When it is not necessary to use the self-contained finger sleeve (the self-contained finger sleeve is in a self-contained condition), the thumb pocket is stored in the storing space enclosed by the cover and the four-finger pocket (i.e. in a self-contained manner) so that the self-contained finger sleeve has a shape of a rectangular box favouring portability. After using the self-contained finger sleeve, the self-contained finger sleeve is changed from the unfolded condition back to the self-contained condition so that surfaces of the thumb pocket and the four-finger pocket potentially in contact with bacteria or virus are enclosed within the rectangular box to avoid secondary pollution, thereby improving safety.

Specifically, when it is necessary to use the self-contained finger sleeve to, for example, open a door, press a button, or hold a handle, flip open the cover by one hand, grab and hold the cover using the same hand, and then insert a thumb of another hand into the thumb pocket, while the remaining four fingers of said another hand get hold of an outer bottom side of the four-finger pocket; after that, the hand grabbing and holding the cover pulls the cover downward; since an edge of the opening of the cover is connected with an edge of the pocket opening of the four-finger pocket, downward movement of the cover in cooperation with the four fingers of said another hand getting hold of the outer bottom side of the four-finger pocket drives the four-finger pocket to flip inside out (inner wall of the four-finger pocket is flipped inside out to become an outer wall, and likewise, outer wall of the four-finger pocket is flipped outside in to become an inner wall); thus, the pocket opening of the four-finger pocket after being flipped inside out no longer aligns with the opening of the cover but is positioned at the rear surface of the cover; also, the thumb pocket is also exposed from the storing space and positioned on one side of the four-finger pocket due to inside-out flipping of the four-finger pocket; due to the connection between the four-finger pocket and the thumb pocket via the U-shaped connecting strap, the thumb pocket and the inside-out four-finger pocket form an ergonomically suitable sleeve structure for all fingers of said another hand of a user. With this deformed and unfolded self-contained finger sleeve, user can open the door, press the button or hold the handle. Portions of the self-contained finger sleeve in contact with the door, the button, or the handle are outer side surfaces of the thumb pocket and outer side surfaces of the inside-out four-finger pocket (i.e. the inner wall of the four-finger pocket before the four-finger pocket is flipped inside out to achieve an unfolded condition of the self-contained finger sleeve). Accordingly, the user can avoid direct contact with bacteria or virus.

3. Since the use of the self-contained finger sleeve requires changes between its different conditions, and because the self-contained finger sleeve is made of elastic materials, downward pulling of the cover during changes of different conditions of the self-contained finger sleeve will easily result in shearing between the cover and the four-finger pocket at two ends of the connecting portion between the cover and the four-finger pocket due to frequent pulling of the cover. Therefore, the two ends of the connecting portion between the cover and the four-finger pocket are formed as arcs respectively, so that shearing force between the cover and the four-finger pocket during folding and unfolding processes is mitigated to the greatest extent, thereby significantly lowering the risk of shearing at the two ends of the connecting portion between the cover and the four-finger pocket during folding and unfolding processes to and from the self-contained condition and unfolded condition of the self-contained finger sleeve, thus enhancing the durability of the self-contained finger sleeve.
4. An outer contour of the cover and an outer contour of the four-finger pocket are supported by shaping frames positioned at framing edges of a front surface of the cover, framing edges of a rear surface of the cover, framing edges of a front surface of the four-finger pocket, and framing edges of a rear surface of the four-finger pocket respectively. When the self-contained finger sleeve is in a self-contained condition where the front surface of the cover aligns with the front surface of the four-finger pocket, and the rear surface of the cover aligns with the rear surface of the four-finger pocket, the shaping frames of the cover align with the shaping frames of the four-finger pocket so that the self-contained finger sleeve in said self-contained condition has a shape of a rounded-corner rectangle when viewing from both a front surface and a rear surface of the self-contained finger sleeve. This same shape of the self-contained finger sleeve in the self-contained condition can be maintained by the shaping frames after the self-contained finger sleeve changes from the self-contained condition to the unfolded condition and then back to the self-contained condition, thereby further enhancing the durability of the self-contained finger sleeve.
5. The cover, the four-finger pocket, the U-shaped connecting strap, and the thumb pocket are integrally connected in sequence so that the self-contained finger sleeve is formed integrally as a one whole piece which facilitates changes between different conditions of the self-contained finger sleeve.
6. A fixing structure is provided between the cover and the four-finger pocket to fix the cover and the four-finger pocket together when the self-contained finger sleeve is in the self-contained condition. As such, after using the self-contained finger sleeve, surfaces of the thumb pocket and the four-finger pocket potentially in contact with bacteria or virus can be locked within the self-contained finger sleeve shaped as a rectangular box, thereby preventing easy opening of the self-contained finger sleeve.
7. The four-finger pocket is a single pocket instead of comprising multiple sub-pockets for different fingers, so that the four-finger pocket can be flipped inside out more easily, and it is no longer necessary to specify whether the finger sleeve is intended for use by a left hand or a right hand. Since the thumb pocket is positioned relative to a middle part of the four-finger pocket instead of biasing to the left or right of the four-finger pocket, the self-contained finger sleeve of the present invention is suitable for use by both left and right hands.
8. When the self-contained finger sleeve is in said unfolded condition where the thumb pocket and the inside-out four-finger pocket form an ergonomically suitable sleeve structure for all fingers of said another hand of the user, an inner side surface of the inside-out four-finger pocket corresponding to where the four fingers get hold of the four-finger pocket is integrally provided with an anti-slippery protrusion to increase frictions force between the inside-out four-finger pocket and the four fingers.

DETAILED DESCRIPTION OF THE INVENTION

The present invention is further explained in the following with reference to some embodiments.

EMBODIMENT 1

Figure 1:
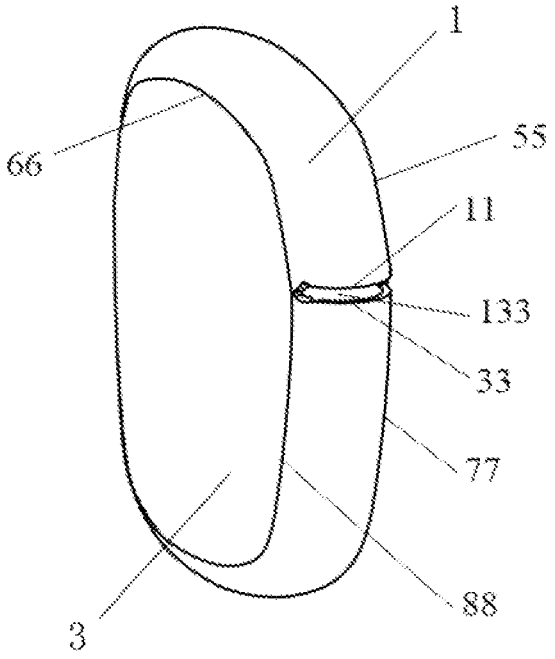
FIG. 1 is a perspective view of the self-contained finger sleeve in a self-contained condition according to a first embodiment of the present invention.
Figure 2:
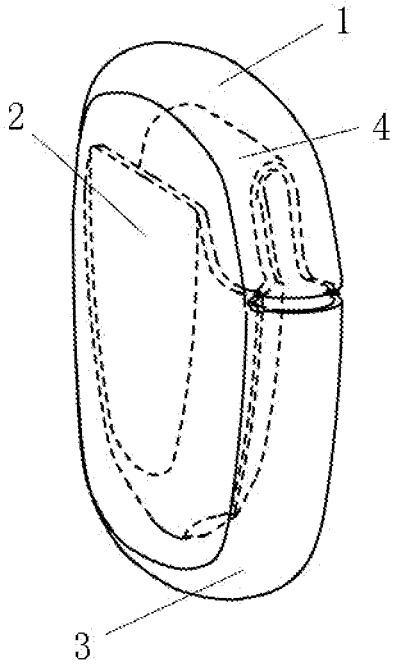
FIG. 2 is a perspective see-through view of the self-contained finger sleeve in a self-contained condition according to a first embodiment of the present invention.

As shown in FIGS. 1 and 2, a self-contained finger sleeve, made of silicone, comprises a cover 1, a thumb pocket 2, a four-finger pocket 3, and a U-shaped connecting strap 4.

The cover 1 has an opening 11, the four-finger pocket 3 has a pocket opening 33, and the thumb pocket 2 also has a pocket opening 22; an edge of the pocket opening of the four-finger pocket 3 is connected to an edge of the opening of the cover 1; and an opposite edge of the pocket opening of the four-finger pocket 3 is connected to an edge of the pocket opening of the thumb pocket 2 via the U-shaped connecting strap 4; the cover 1, the four-finger pocket 3, the U-shaped connecting strap 4, and the thumb pocket 2 are therefore integrally connected in sequence.

Figure 3:
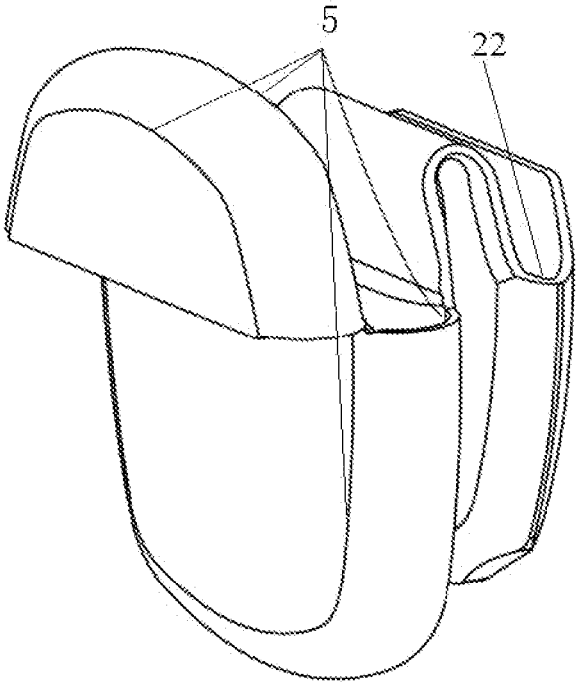
FIG. 3 is a first perspective view of the self-contained finger sleeve in an unfolded condition according a first embodiment of the present invention.

Specifically, as shown in FIG. 3, an outer contour of the cover 1 and an outer contour of the four-finger pocket 3 are supported by shaping frames 5 positioned at framing edges 55 of a front surface of the cover 1, framing edges 66 of a rear surface of the cover 1, framing edges 77 of a front surface of the four-finger pocket 3, and framing edges 88 of a rear surface of the four-finger pocket 3 respectively. In this embodiment, each of the shaping frames 5 is a convex plastic strip. The shaping frames 5 of the cover 1 and the four-finger pocket 3 are integrally formed in the cover 1 and the four-finger pocket 3 respectively. When the self-contained finger sleeve is in a self-contained condition where the front surface of the cover 1 aligns with the front surface of the four-finger pocket 3, and the rear surface of the cover 1 aligns with the rear surface of the four-finger pocket 3, the shaping frames 5 of the cover 1 align with the shaping frames 5 of the four-finger pocket 3 so that the self-contained finger sleeve in said self-contained condition has a shape of a rounded-corner rectangle when viewing from both a front surface and a rear surface of the self-contained finger sleeve, where four corners of the rounded-corner rectangle are rounded corners.

Figure 4:
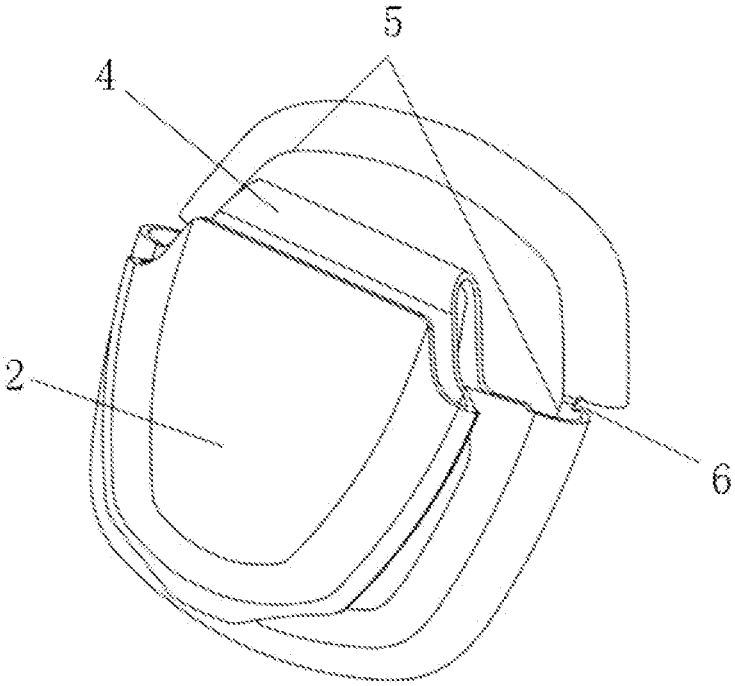
FIG. 4 is a second perspective view of the self-contained finger sleeve in an unfolded condition according a first embodiment of the present invention.

Also, as shown in FIG. 4, two ends of a connecting portion between the cover 1 and the four-finger pocket 3 are formed as arcs 6 respectively; and the opening of the cover 1 and the pocket opening of the four-finger pocket 3 correspond to each other in terms of shape.

Said four-finger pocket 3 is a single pocket where index finger, middle finger, ring finger and little finger are inserted into during use.

When the self-contained finger sleeve is not in use, it is in said self-contained condition. In said self-contained condition, the opening of the cover 1 and the pocket opening of the four-finger pocket 3 face towards each other such that interior of the cover 1 and interior of the four-finger pocket 3 are in communication with each other to define a storing space 133, and the thumb pocket 2 and the U-shaped connecting strap 4 are positioned in the storing space and enclosed by the cover 1 and the four-finger pocket 3.

As said, the self-contained finger sleeve in said self-contained condition has a shape of a rounded-corner rectangle when viewing from both a front surface and a rear surface of the self-contained finger sleeve. A three dimensional shape of the self-contained finger sleeve in said self-contained condition is a rounded-corner rectangular box, which is favourable for carrying.

Figure 5:
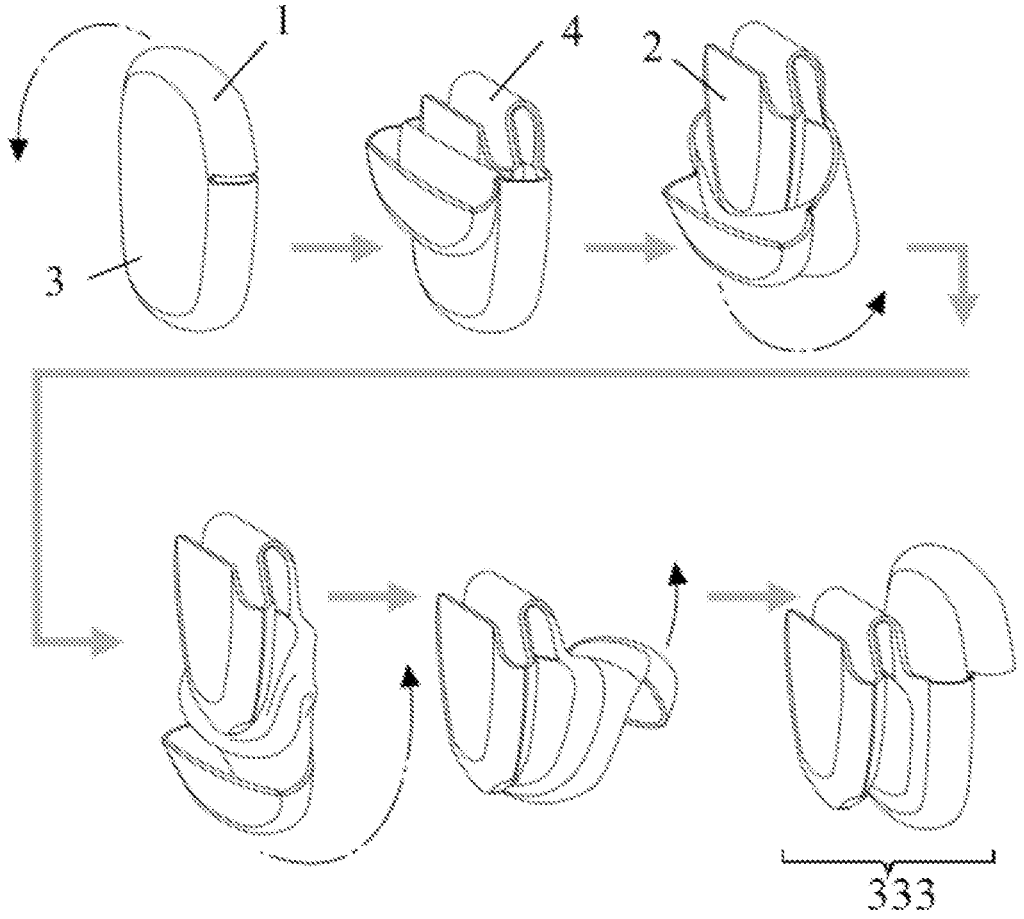
FIG. 5 is a flow chart that schematically illustrates the self-contained finger sleeve changing from a self-contained condition to an unfolded condition according to a first embodiment of the present invention.

As shown in FIG. 5, when it is necessary to use the self-contained finger sleeve as an intermediate barrier object to, for example, open a door, press a button, or hold a handle, so as to avoid direct contact with the door, button or handle, flip open the cover 1 by one hand, grab and hold the cover 1 using the same hand, and then insert a thumb of another hand into the thumb pocket 2, while the remaining four fingers of said another hand get hold of an outer bottom side of the four-finger pocket 3; after that, the hand grabbing and holding the cover 1 pulls the cover 1 downward; since an edge of the opening of the cover 1 is connected with an edge of the pocket opening of the four-finger pocket 3, downward movement of the cover 1 in cooperation with the four fingers of said another hand getting hold of the outer bottom side of the four-finger pocket 3 drives the four-finger pocket 3 to flip inside out (inner wall of the four-finger pocket 3 is flipped inside out to become an outer wall, and likewise, outer wall of the four-finger pocket 3 is flipped outside in to become an inner wall); thus, the pocket opening of the four-finger pocket 3 after being flipped inside out is positioned at the rear surface of the cover 1 and does not align with the opening of the cover 1; also, the thumb pocket 2 is also exposed from the storing space and positioned on one side of the four-finger pocket 3 due to inside-out flipping of the four-finger pocket 3; due to the connection between the four-finger pocket 3 and the thumb pocket 2 via the U-shaped connecting strap 4, the thumb pocket 2 and the inside-out four-finger pocket 3 form an ergonomically suitable sleeve structure 333 (the self-contained finger sleeve is now in an unfolded condition) for all fingers of said another hand of a user where the thumb of said another hand of the user is in the thumb pocket 2 and the remaining four fingers of said another hand of the user is in the pocket opening of the inside-out four-finger pocket. With this deformed and unfolded self-contained finger sleeve, user can open the door, press the button or hold the handle safely. Portions of the self-contained finger sleeve in contact with the door, the button, or the handle are outer side surfaces of the thumb pocket 2 and outer side surfaces of the inside-out four-finger pocket 3. Accordingly, the user can avoid direct contact with bacteria or virus.

Further, in this embodiment, when the self-contained finger sleeve is in said unfolded condition where the thumb pocket 2 and the inside-out four-finger pocket 3 form an ergonomically suitable sleeve structure for all fingers of said another hand of the user, an inner side surface of the inside-out four-finger pocket 3 corresponding to where the four fingers get hold of the four-finger pocket 3 is integrally provided with an anti-slippery protrusion to increase frictions force between the inside-out four-finger pocket 3 and the four fingers.

Figure 6:
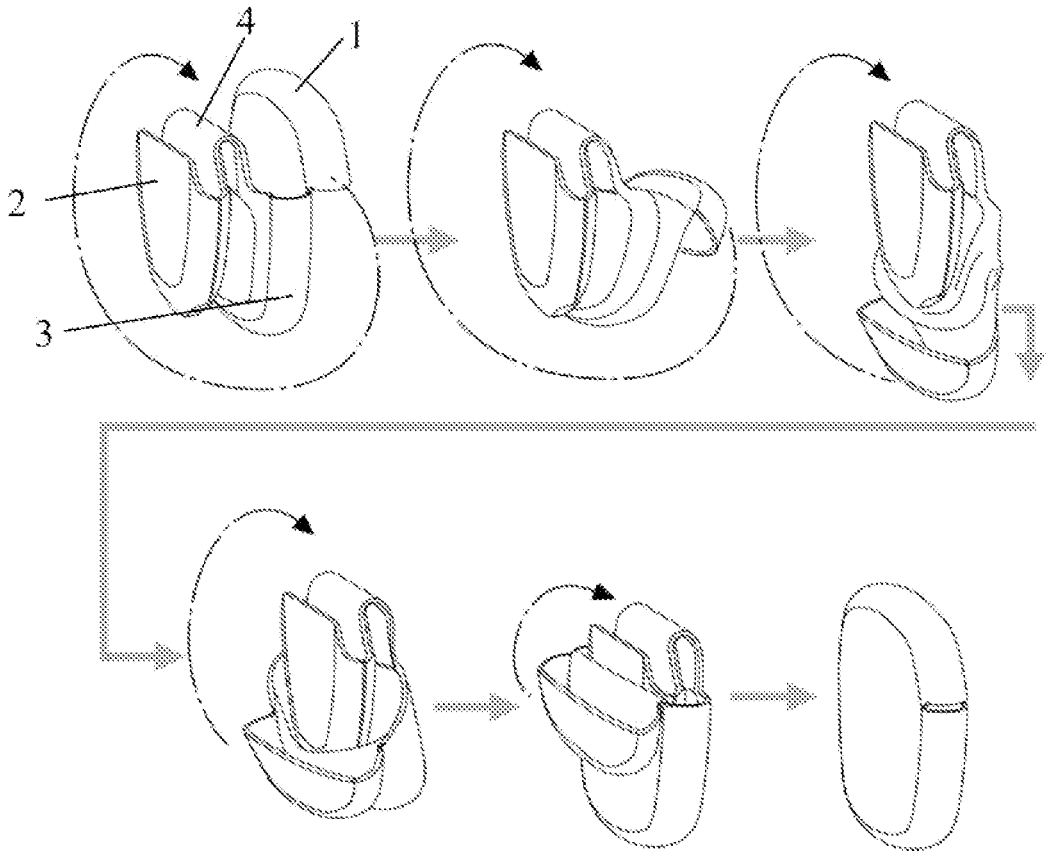
FIG. 6 is a flow chart that schematically illustrates the self-contained finger sleeve changing from an unfolded condition to a self-contained condition according to a first embodiment of the present invention.

As shown in FIG. 6, when it is necessary to fold the self-contained finger sleeve into a self-contained condition after use, the hand that grabs the cover 1 during unfolding of the self-contained finger sleeve now pulls the cover 1 downward and then flips the cover 1 upward again, and the four-finger pocket 3 is driven to flip inside out again (the inner wall of the previously flipped inside-out four-finger pocket 3 is flipped inside out again to become the outer wall of the four-finger pocket 3, and the outer wall of the previously flipped inside-out four-finger pocket 3 is likewise flipped outside in to become the inner wall of the four-finger pocket 3) under pressing force of the thumb pocket 2. After the self-contained finger sleeve is folded again back to the self-contained condition, the opening of the cover 1 and the pocket opening of the four-finger pocket 3 face towards each other again, and the thumb pocket 2 and the U-shaped connecting strap 4 are once again enclosed within the storing space defined by the cover 1 and the four-finger pocket 3. Accordingly, the self-contained finger sleeve returns back to a self-contained condition. In such self-contained condition, surfaces of the thumb pocket 2 and the four-finger pocket 3 previously in contact with bacteria or virus during use are now positioned within the storing space.

Further, since the two ends of the connecting portion between the cover 1 and the four-finger pocket 3 are formed as arcs 6 respectively, shearing force between the cover 1 and the four-finger pocket 3 during folding and unfolding processes is mitigated to the greatest extent, thereby significantly lowering the risk of shearing at the two ends of the connecting portion between the cover 1 and the four-finger pocket 3 during folding and unfolding processes to and from the self-contained condition and unfolded condition of the self-contained finger sleeve, thus enhancing the durability of the self-contained finger sleeve.

Besides, as mentioned above, an outer contour of the cover 1 and an outer contour of the four-finger pocket 3 are supported by shaping frames 5 positioned at framing edges of a front surface of the cover 1, framing edges of a rear surface of the cover 1, framing edges of a front surface of the four-finger pocket 3, and framing edges of a rear surface of the four-finger pocket 3 respectively. When the self-contained finger sleeve is in a self-contained condition where the front surface of the cover 1 aligns with the front surface of the four-finger pocket 3, and the rear surface of the cover 1 aligns with the rear surface of the four-finger pocket 3, the shaping frames 5 of the cover 1 align with the shaping frames 5 of the four-finger pocket 3 so that the self-contained finger sleeve in said self-contained condition has a shape of a rounded-corner rectangle when viewing from both a front surface and a rear surface of the self-contained finger sleeve. This same shape of the self-contained finger sleeve in the self-contained condition can be maintained by the shaping frames after the self-contained finger sleeve changes from the self-contained condition to the unfolded condition and then back to the self-contained condition, thereby further enhancing the durability of the self-contained finger sleeve.

Moreover, said four-finger pocket 3 is a single pocket instead of comprising multiple sub-pockets for different fingers, the four-finger pocket 3 can be flipped inside out more easily, and it is no longer necessary to specify whether the finger sleeve is intended for use by a left hand or a right hand. Since the thumb pocket 2 is positioned relative to a middle part of the four-finger pocket 3 instead of biasing to the left or right of the four-finger pocket 3, the self-contained finger sleeve of the present invention is suitable for use by both left and right hands.

Lastly, the cover 1, the four-finger pocket 3, the U-shaped connecting strap 4, and the thumb pocket 2 are integrally connected in sequence so that the self-contained finger sleeve is formed integrally as a one whole piece which facilitates changes between different conditions of the self-contained finger sleeve as described above.

EMBODIMENT 2

Figure 7:
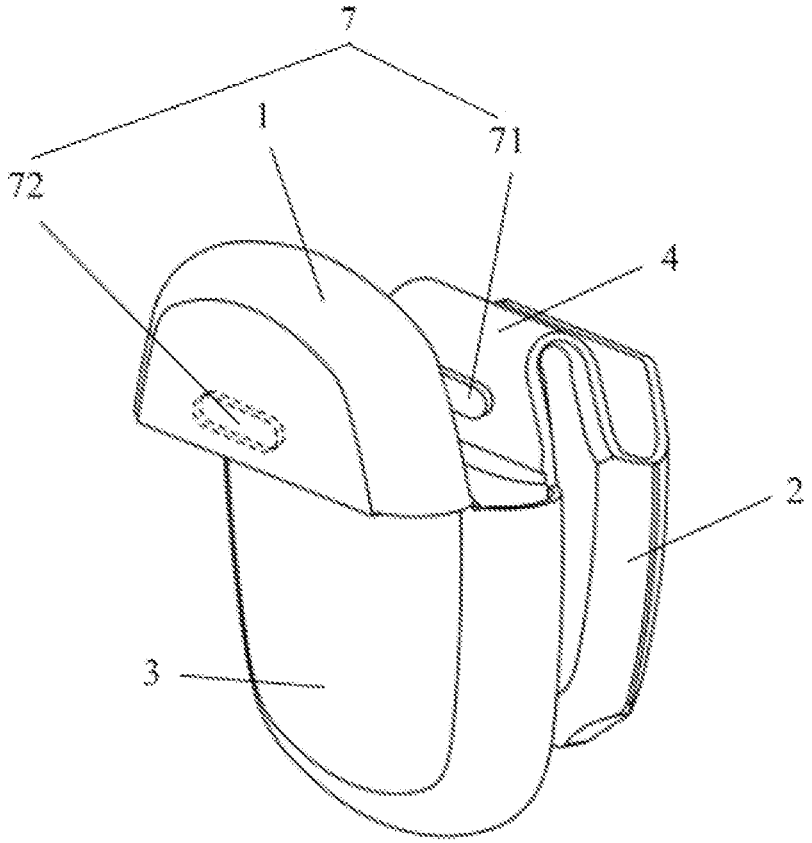
FIG. 7 is a perspective view of the self-contained finger sleeve in an unfolded condition according to a second embodiment of the present invention.

FIG. 7 illustrates a second embodiment of the self-contained finger sleeve of the present invention. This second embodiment is the same as the first embodiment except for the following: a fixing structure Z is provided between the cover 1 and the four-finger pocket 3 to fix the cover 1 and the four-finger pocket 3 together when the self-contained finger sleeve is in the self-contained condition. As such, after using the self-contained finger sleeve, surfaces of the thumb pocket 2 and the four-finger pocket 3 potentially in contact with bacteria or virus can be locked within the self-contained finger sleeve shaped as a rectangular box, thereby preventing easy opening of the self-contained finger sleeve. Specifically, the fixing structure is a fastening structure comprising a fastener 71 and a fastening seat 72, wherein the fastener 71 is positioned on a side of the U-shaped connecting strap 4 facing towards the cover 1 when the self-contained finger sleeve is unfolded to the unfolded condition; correspondingly, the fastening seat 72 is provided on an inner side of the cover 1 facing towards the fastener 71 when the self-contained finger sleeve is folded into the self-contained condition. The fastener 71 and the fastening seat 72 are integrally molded into the self-contained finger sleeve.

The embodiments described above are only preferred embodiments of the present invention, but not intended to limit the scope of the present invention. Any changes made in accordance with the shape and principle of the present invention should fall within the scope of the present invention.

What is claimed is:

1. A self-contained finger sleeve, characterized by being made of an elastic material, and comprising a cover (1), a thumb pocket (2), and a four-finger pocket (3);

wherein the cover (1) has an opening (11), the four-finger pocket (3) has a pocket opening (33), and the thumb pocket (2) also has a pocket opening (22); an edge of the pocket opening (33) of the four-finger pocket (3) is connected to an edge of the opening (11) of the cover (1); and an opposite edge of the pocket opening (33) of the four-finger pocket (3) is connected to an edge of the pocket opening (22) of the thumb pocket (2) via a U-shaped connecting strap (4);

the opening (11) of the cover (1) has a shape that corresponds to a shape of the pocket opening (33) of the four-finger pocket (3);

in a self-contained condition of the self-contained finger sleeve, the opening (11) of the cover (1) and the pocket opening (33) of the four-finger pocket (3) face towards each other such that interior of the cover (1) and interior of the four-finger pocket (3) are in communication with each other to define a storing space (133), and the thumb pocket (2) and the U-shaped connecting strap (4) are positioned in the storing space (133) and enclosed by the cover (1) and the four-finger pocket (3);

in an unfolded condition of the self-contained finger sleeve, the four-finger pocket (3) is flipped inside out, and the pocket opening (33) of the four-finger pocket (3) after being flipped inside out is misaligned with the opening (11) of the cover and positioned at a rear surface of the cover (1); also, the thumb pocket (2) is exposed from the storing space (133) and positioned on one side of the four-finger pocket (3) flipped inside out; with the four-finger pocket (3) and the thumb pocket (2) connected via the U-shaped connecting strap (4), the thumb pocket (2) and the four-finger pocket (3) flipped inside out form an ergonomic finger sleeve (333).

2. The self-contained finger sleeve of claim 1, wherein the cover (1), the four-finger pocket (3), the U-shaped connecting strap (4), and the thumb pocket (2) are integrally connected in sequence.

3. The self-contained finger sleeve of claim 1, wherein an outer contour of the cover (1) and an outer contour of the four-finger pocket (3) are supported by shaping frames (5) positioned at framing edges (55) of a front surface of the cover (1), framing edges (66) of the rear surface of the cover (1), framing edges (77) of a front surface of the four-finger pocket (3), and framing edges (88) of a rear surface of the four-finger pocket (3) respectively; when the self-contained finger sleeve is in the self-contained condition where the front surface of the cover (1) aligns with the front surface of the four-finger pocket (3), and the rear surface of the cover (1) aligns with the rear surface of the four-finger pocket (3), the shaping frames (5) of the cover (1) align with the shaping frames (5) of the four-finger pocket (3) so that the self-contained finger sleeve in said self-contained condition has a shape of a rectangle when viewing from both a front surface and a rear surface of the self-contained finger sleeve.

4. The self-contained finger sleeve of claim 3, wherein the self-contained finger sleeve in said self-contained condition has the shape of a rounded-corner rectangle when viewing from both the front surface and the rear surface of the self-contained finger sleeve, where four corners of the rounded-corner rectangle are rounded corners.

5. The self-contained finger sleeve of claim 1, wherein two ends of a connecting portion between the cover (1) and the four-finger pocket (3) are formed as arcs (6) respectively.

6. The self-contained finger sleeve of claim 1, wherein a fixing structure (7) is provided between the cover (1) and the four-finger pocket (3) to fix the cover (1) and the four-finger pocket (3) together when the self-contained finger sleeve is in the self-contained condition.

7. The self-contained finger sleeve of claim 6, wherein the fixing structure (7) is a fastening structure.

8. The self-contained finger sleeve of claim 1, wherein the four-finger pocket (3) is a single pocket, configured to accommodate an index finger, a middle finger, a ring finger and a little finger of a user's hand.

9. The self-contained finger sleeve of claim 1, wherein when the self-contained finger sleeve is in said unfolded condition where the thumb pocket (2) and the four-finger pocket (3) flipped inside out form the ergonomic finger sleeve (333), an inner side surface of the four-finger pocket (3) flipped inside out corresponding to where the four-finger pocket is grabbed and held is integrally provided with an anti-slippery protrusion.

10. The self-contained finger sleeve of claim 1, wherein the elastic material is silicone or rubber.

* * * * *